US005813785A

United States Patent [19]

Baudin et al.

[11] Patent Number: 5,813,785

[45] Date of Patent: Sep. 29, 1998

[54] DEVICE FOR THE PACKAGING, DISPENSING AND APPLICATION OF A GEL OR FOAM

[75] Inventors: Gilles Baudin, Domont; Nicolas Albisetti, Sevran, both of France

[73] Assignee: L'Oreal, Paris, France

[21] Appl. No.: 790,367

[22] Filed: Jan. 28, 1997

[30] Foreign Application Priority Data

Jan. 29, 1996 [FR] France ..... 96 01003

[51] Int. Cl.[6] ..... A45D 34/00; A45D 34/04

[52] U.S. Cl. ..... 401/190; 401/266

[58] Field of Search ..... 401/190, 266

[56] References Cited

U.S. PATENT DOCUMENTS

| | | | |
|---|---|---|---|
| 2,897,526 | 8/1959 | Dootson | 401/190 |
| 3,685,913 | 8/1972 | Pass | 401/190 |
| 4,089,609 | 5/1978 | Gring et al. | 401/190 |
| 4,753,547 | 6/1988 | Dodero | 401/190 |
| 5,567,073 | 10/1996 | de Laforcade et al. | 401/190 |

FOREIGN PATENT DOCUMENTS

| | | | |
|---|---|---|---|
| 1288391 | 9/1991 | Canada | 401/190 |
| 0 155 350 | 9/1985 | European Pat. Off. . | |
| 0 655 208 | 5/1995 | European Pat. Off. . | |
| 2 607 752 | 6/1988 | France . | |
| 2331694 | 1/1975 | Germany | 401/190 |
| 466176 | 1/1969 | Switzerland | 401/190 |
| 1284369 | 6/1970 | United Kingdom | 401/190 |
| 2198035 | 6/1988 | United Kingdom | 401/190 |

*Primary Examiner*—Steven A. Bratlie
*Attorney, Agent, or Firm*—Young & Thompson

[57] ABSTRACT

A device for the packaging, dispensing and application of a product packaged in a liquid form and dispensed in the form of a foam or gel. The device has a pressurized container (2) containing the product, an actuating valve (4), and an applicator element (9) for applying the product. The applicator element (9) has an external application surface **(9*a*) made of a porous non-deformable material and has in addition to the pores, at least one duct (10) traversing the element (9) so as to open out on the external application surface (9*a*) in the form of an opening (10*a*), and to allow the product to emerge on the application surface in the form of a foam or gel in response to an actuation of the valve (4)**.

21 Claims, 3 Drawing Sheets

FIG. 1
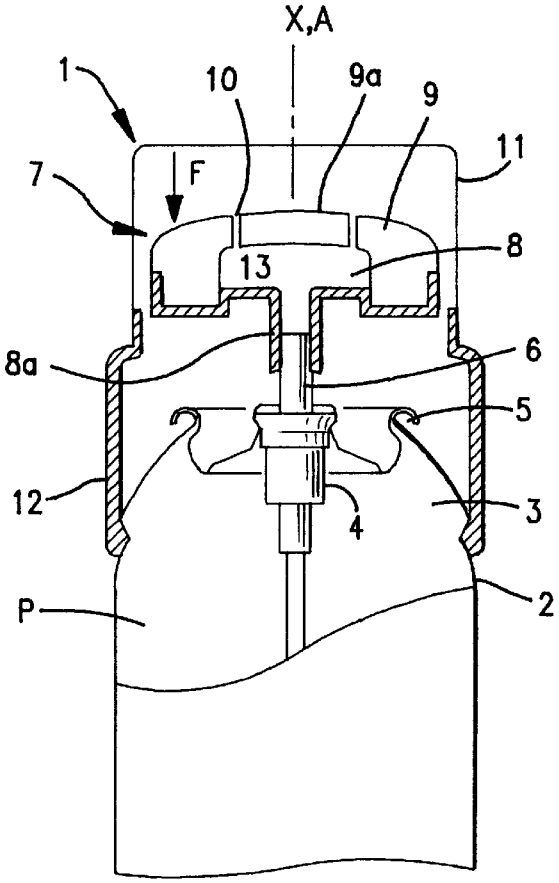
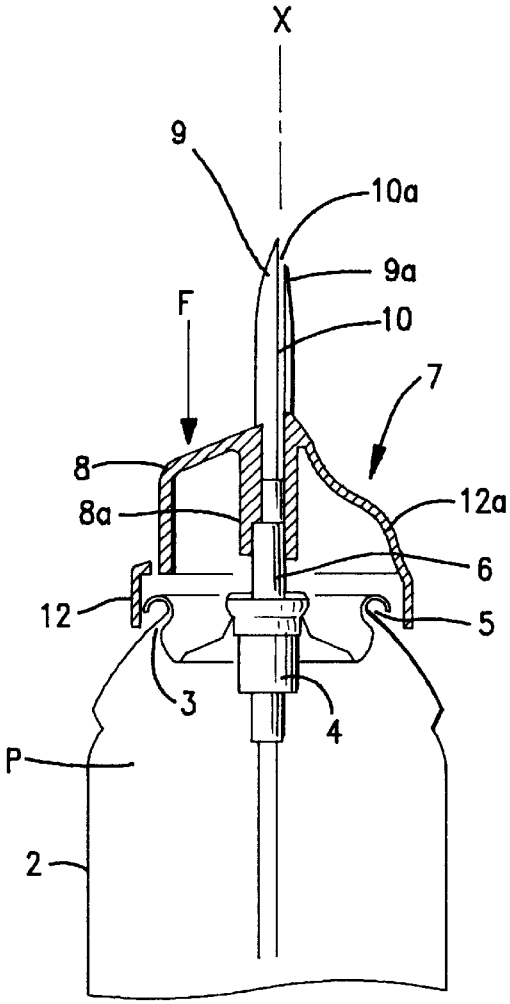
FIG. 2
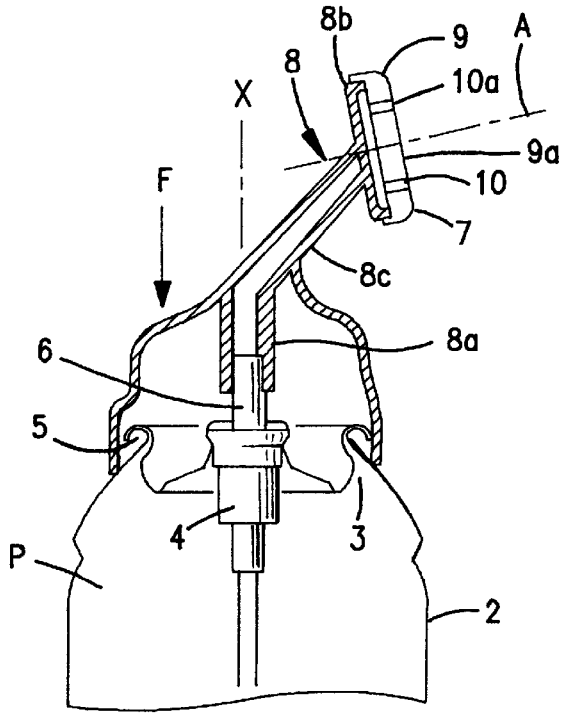
FIG. 3

DEVICE FOR THE PACKAGING, DISPENSING AND APPLICATION OF A GEL OR FOAM

BACKGROUND OF THE INVENTION

1. Field of the Invention

The invention relates to a device for the packaging of a liquid product and for the dispensing and application of this product in the form of a foam or gel. This device serves in particular for the dispensing and application of a fixing foam for the hair, a depilatory foam, a shaving foam or a self-foaming shaving gel.

2. Description of Related Art

Generally, conventional devices for dispensing liquid products in the form of a foam will comprise a pressurized container. A dispensing head mounted on this container comprises a dispensing valve provided with an actuating stem and a dispensing element. This dispensing element comprises a nozzle on which an end grill is catch-engaged.

When a mechanical pressure is exerted on it the dispensing element delivers the product through the grill to emerge in the form of a foam. The presence of this nozzle provided with its grill permits a dosed and localized dispensing of the foam.

Unfortunately, because of the continued emergence of the foam in the absence of any mechanical pressure on the dispensing element, this known device gives rise to the presence of a foam residue on the grill after the foam has been taken up.

Moreover, the use of such a foam dispenser requires the use of an additional subsidiary brush-type applicator for the shaving foam, or merely use of the hand for shaving foam, setting foam for the hair, or depilatory foam, which makes the use of this dispenser tedious.

For products of a deodorant type in a liquid form dispenser-applicator devices are, moreover, known to have a structure similar to that of the above-mentioned device, but wherein the applicator element comprises a sintered porous material and has no grill. Such a device is described in particular in EP-A-0 655 208. Due to mechanical pressure on the sintered material, the liquid product is ejected through the valve at the center of the dispensing element and is diffused by capillarity towards the outside of this element. The element which is then impregnated by micro-droplets of the liquid product can be used as an applicator on the skin. Unfortunately, this type of device does not make it possible to obtain from a liquid product a foam uniformly spread over the application surface. The product is, in particular, always extracted in a liquid form.

From U.S. Pat. No. 4,089,609, there is also known a dispenser applicator-device, for a shaving foam, which comprises a sponge as an applicator element, which is pierced by two longitudinal ducts. The use of this type of applicator has the drawback of a non-uniform dispensing of the product on the applicator, and of rough contact with the skin. Moreover, the sponge is made of an elastically compressible material which may, during the application, cause the ducts to become clogged up rendering the ducts inoperative.

Thus there exists the need for a new packaging, dispensing and application device that simultaneously permits (i) a soft contact with the skin, thanks to an appropriate applicator element, (ii) a channelled dispensing of the foamy product when, in particular, a mechanical pressure is exerted on the applicator element, and (iii) a cessation of the emergence of the product when this mechanical pressure stops. Thus the drawbacks of the prior art, which are linked to the nature and/or the structure of the applicator element and/or of the device as a whole, are remedied.

SUMMARY OF THE INVENTION

The present invention therefore provides a device for the packaging, dispensing and application of a product packaged in a liquid form and dispensed in the form of a foam or gel, comprising a pressurized container containing the product, an actuating valve, and an applicator element for applying the product, characterized in that the applicator element has an external application surface made of a porous non-deformable material and comprises, in addition to the pores, at least one duct traversing the applicator element so as to open out on the external application surface in the form of at least one opening, and to allow the product to emerge on the application surface in the form of a foam or of a gel in response to an actuation of the valve. The pores of the material forming the applicator element make it possible to experience during application to the skin the softness and the comfort required in such an application. Moreover, they permit a uniform distribution of the product over the applicator.

Advantageously, the duct passes through the whole thickness of the applicator element, where the thickness of the element is measured along an axis A substantially perpendicular to the application surface.

This new device has the advantage of having a large and localized flow of the foam or gel at the outlet of the applicator element. This device also allows the foam or gel to be directly applied to the skin as it emerges from the container. Another advantage of this device is that it permits a channelled and homogeneous spreading of the foam or gel.

The product at the outlet of the container may be in the form of a gel, a foam or a self-foaming gel. To ensure the emergence of the product the container moreover contains a propellant agent dissolved in, or separate from, the liquid, such as nitrogen, a liquefied hydrocarbon or air. The liquid may moreover contain a foam expansion agent such as isobutane. The use of a propellant makes it possible, furthermore, to bring freshness to the skin.

Preferably, the device has several openings distributed advantageously uniformly over the surface of the applicator element. They may be situated at the center of the surface. Preferably, they are distributed symmetrically around the axis A.

The size of the openings may be from 0.4 mm to 6 mm and preferably from 0.8 mm to 2 mm. The openings may have a particular shape. Their size and shape make it possible to obtain at the outlet of the applicator element a foam or gel, for example, in the form of bands, strings or more precisely, spaghetti.

The external surface of the applicator element may be made of a sintered porous material chosen from the so-called "soft" materials such as ethylene vinyl acetate (EVA) or from synthetic resins such as high or low density polyethylenes, polypropylenes or polyvinyl fluorides. As a variant, the applicator element may be made of a rigid synthetic foam with open cells.

The porosity of this material may be from 1 $\mu$m to 300 $\mu$m and preferably from 10 $\mu$m to 100 $\mu$m.

To allow a very soft application of the product to be effected, the applicator element advantageously has an application surface whose average roughness is chosen within a range extending from 0.5 μm to 100 μm, and preferably within a range extending from 6 μm to 50 μm.

A specific combination of the size and of the geometric shape of the outlet openings with the porosity values of the sintered material makes it possible to adapt the applicator element to the type of product extracted from the container, whether it is a foaming or a self-foaming product (gel or foam).

According to the consistency of the product, the number and shape of the openings, as well as the porosity of the sintered material, the thickness of the sintered material may be chosen to be from 0.5 mm to 20 mm and preferably from 1 mm to 5 mm.

The device in accordance with the invention may serve for the dispensing with a view to the application of a shaving foam and of a depilatory foam, or also of a hair setting foam.

The applicator element may be fixed either directly on the valve and more particularly on the actuating stem of the valve, or mounted on the valve stem by means of a support.

BRIEF DESCRIPTION OF THE DRAWINGS

Apart from the arrangements set out above, the invention consists of a certain number of other arrangements which will be explained below with regard to examples of embodiments described with reference to the attached Figures which are in no way limiting, and in which:

FIG. 1 is a schematic view in an axial section of a device in accordance with a first variant of the invention;

FIG. 2 is a schematic sectional view, similar to FIG. 1, of a device in accordance with a second variant of the invention;

FIG. 3 is a schematic sectional view similar to FIG. 1, of a device in accordance with a third variant of the invention;

DESCRIPTION OF THE PREFERRED EMBODIMENTS

Figure 4A:
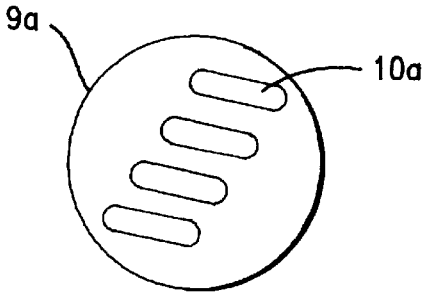
FIG. 4A–4H represents various shapes of the external surface of the applicator element in a top view.

Referring to FIG. 1, there may be seen a packaging, dispensing and applicator device generally designated by the reference numeral 1, having an axis of symmetry X and comprising a generally cylindrical container 2 pressurized by means of a propellant gas and containing a liquid product P. This container carries at its upper end a cup 3 of a valve 4 fixed to the container by a crimped bead 5. In its upper portion, the valve 4 has a hollow actuating stem 6 on which a dispensing head 7 is fixed. This head 7 is constituted by a receptacle 8 which is fitted on the stem 6 via a hollow sleeve 8*a*. A slightly curved outwardly convex dome is mounted on the receptacle 8, and is made of a sintered, porous non-deformable material, in particular of polyethylene, with a porosity ranging from 1 to 300 μm. This dome 9, which constitutes the element for applying the product to the skin, is traversed by one or several ducts 10 which allow the product to emerge in the form of a foam or gel at the openings 10*a* on the application surface 9*a*. The dome 9 is fitted in the receptacle 8. It is also possible to ensure the fixing of the dome 9 on the receptacle 8 by means of a mounting ring (not shown), catch-engaged on the support. An expansion chamber 13 may be provided between the receptacle 8 and the dome 9. In this embodiment the ducts are orientated along an axis A substantially perpendicular to the application surface 9*a*, the axis A coinciding with the axis X. A plurality of such ducts 10 are disposed around the axis A.

The stem 6, the sleeve 8*a* and the perforated receptacle 8 define a dispensing duct for the product P, leading from the container to the dome 9. The device comprises moreover, a protective cap 11 intended to protect the external surface of the dome from ambient dust. The cap is fitted on a cylindrical fixing skirt 12 catch-engaged on the upper portion of the container 2, optionally connected to the receptacle 8 by tabs. This arrangement is described, in particular, in EP-A-0 655 208.

To use the device in accordance with the invention, after removing the protective cap 11, the user exerts a mechanical pressure F by pressing on the application surface 9*a* of the dome 9 outside the zones which comprise the openings 10*a*. The applicator element is thus depressed and, by depressing the stem 6 of the valve 4, causes the valve to open. The product emerges from the container via the stem 6, the sleeve 8*a*, then via the openings 10*a*, in the form of foam; it is accumulated on the surface of the dome 9. The foam is then applied to the skin, and the dome 9 is used as an applicator and as a means for spreading the foam on the skin.

The device in accordance with the invention makes it possible to obtain a sufficient and homogeneous quantity and quality of the foam which can be easily and softly spread on the skin by means of the dome. This dome makes it possible to dispense with a brush, in particular in the case of a shaving foam.

In FIGS. 2 and 3, the elements that are identical to, or which perform functions similar to, the elements described with reference to FIG. 1 are designated by the same reference numerals. Their description will not be repeated or will be repeated only concisely.

FIG. 2 shows a device which differs from that of FIG. 1 in that the dispensing head 7 comprises an applicator in the form of a pointed element 9 formed of a sintered porous material such as defined in FIG. 1. This pointed element is fitted in the sleeve 8*a* of the receptacle 8 and has a duct 10 opening out, on the one hand, at the lower end of the pointed element fitted in the sleeve 8*a*and, on the other hand, on the external application surface 9*a* substantially in the vicinity of the free end of the pointed element 9. This receptacle 8 has, moreover, a general convex shape which is different from that of a cup. The receptacle 8 is locally connected by a peripheral hinge 12*a* to the fixing skirt 12. The bearing of the pointed element 9 on the surface to be treated causes the receptacle 8 to tilt round the hinge 12*a*, then causes the valve stem to be depressed. The product rises up the duct 10 and emerges in the vicinity of the free end of the pointed element 9. Such an applicator is used in the manner of a prong of a comb, in particular in the case of the application of a hair product. Advantageously, a plurality of such applicator elements 9 are mounted on the same pressurized container.

FIG. 3 shows a device which differs from that of FIG. 1 in that the receptacle 8 has a cup-shaped portion 8*b* on which portion the dome 9 of sintered material is fitted, and a duct 8*c* connecting the sleeve 8*a* and the cup-shaped portion 8*b*. The duct 8*c* forms an obtuse angle with the axis X. The functioning is comparable to that of FIG. 1. In the same way as in the case of the embodiment of FIG. 1, the ducts 10 are orientated along an axis A substantially perpendicular to the application surface 9*a*. In contrast to the embodiment of FIG. 1, the axis A does not coincide with the axis X of the container.

The FIGS. 4A–4H show various representations of the external surface 9*a* of the applicator element. The openings 10*a* have various shapes and dimensions. Being associated with one or the other shape of the applicator element of FIGS. 1 to 3, the openings permit the delivery of specifically foaming or self-foaming products in the form of spaghetti or bands.

Thus in FIG. 4A, the openings 10*a* have an oval or elliptical shape, the major axes of each oval or each ellipse being orientated parallel to one another.

Figure 4B:
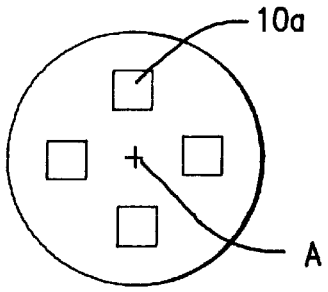

In FIG. 4B, the openings 10*a* have a square shape and are disposed symmetrically relative to the axis A. It is, however, possible to make openings 10*a* of a rectangular shape.

Figure 4C:
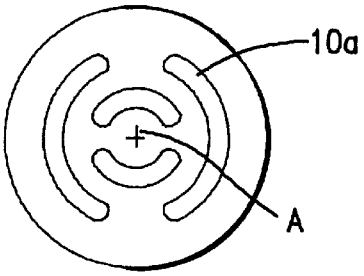

In FIG. 4C, the openings 10*a* have the shape of a circular arc. They are distributed along two concentric circles centred on the axis A and are set off in pairs.

Figure 4D:
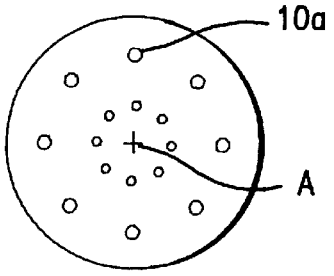

In FIG. 4D, the openings 1O*a* are circular and are disposed along two concentric circles centred on the axis A.

Figure 4E:
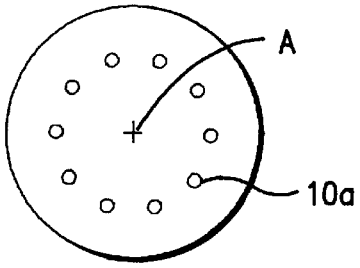

In FIG. 4E, the openings 10*a* are disposed along a single circle, for example, with a diameter of approximately 24 mm, centred on the axis A.

Figure 4F:
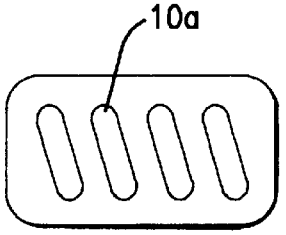

In FIG. 4F, the openings 10*a* are elliptical and their major axes are parallel to one another.

Figure 4G:
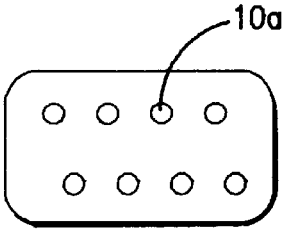

In FIG. 4G, the openings 10*a* are circular and are distributed along two parallel lines.

Figure 4H:
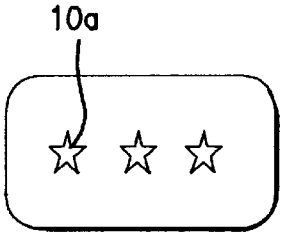

In FIG. 4H, the openings 10*a* are star-shaped and are arranged along the same line.

In FIGS. 4A–4E the application surface has a circular shape, while in the FIGS. 4F–4H it has a rectangular shape.

The emergence of a product in a self-foaming form is facilitated when the device in accordance with FIG. 1 is associated with one of the schematic representations of the surface 9*a* of the applicator element of FIGS. 4A–4E.

FIGS. 5A–5E illustrate several embodiments of the dome 9 traversed by a plurality of ducts 10.

Figure 5A:
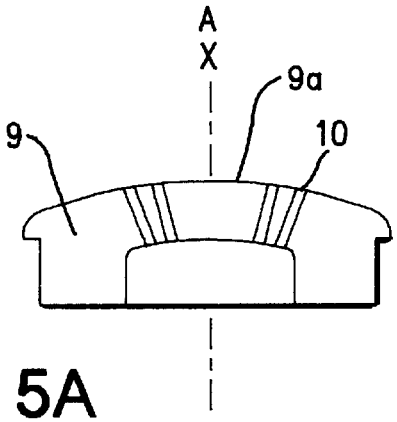
FIG. 5A–5E shows in axial sections various embodiments of the dome traversed by ducts.

Thus FIG. 5A shows ducts 10 inclined relative to the axis A (or X in the case where the two axes coincide). These ducts diverge from the axis A and are arranged along two concentric circles.

Figure 5B:
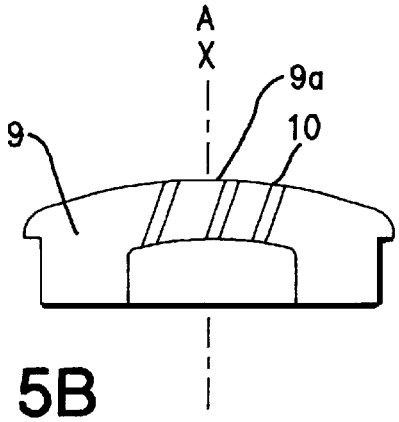

FIG. 5B shows ducts 10 inclined relative to the axis A, these ducts being parallel to one another.

Figure 5C:
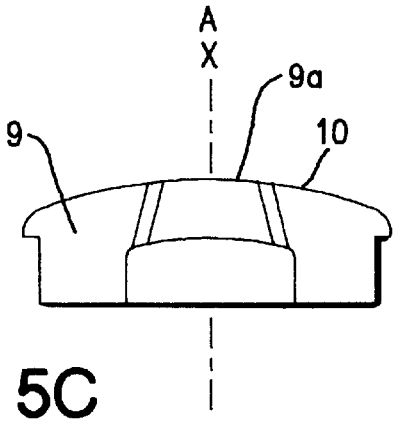

FIG. 5C shows ducts 10 inclined relative to the axis A. These inclined ducts converge towards the axis A.

Figure 5D:
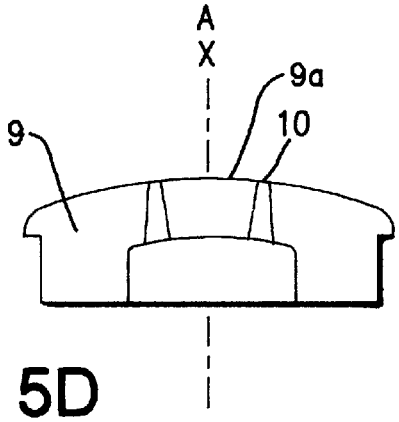

FIG. 5D shows conical ducts 10, the opening (or smaller diameter end) of the cone facing the application surface 9*a*.

Figure 5E:
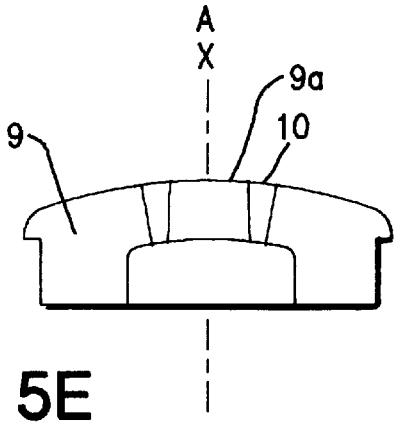

FIG. 5E shows conical ducts 10, the opening (or smaller diameter end) of the cone facing the receptacle of the dome.

What is claimed is:

1. A device for packaging, dispensing and applying a product that is packaged in liquid form and dispensed as one of a foam and a gel, the device comprising:

a pressurized container (2) containing the product in liquid form;

an actuating valve (4) for passing the product from the container;

an applicator element (9) for applying the product as one of a foam and a gel, said applicator element (9) having an external application surface (9*a*) made of a porous non-deformable material and at least one duct (10) traversing said applicator element (9) to an opening (10*a*) in said external application surface (9*a*) to allow the product to emerge through said opening (10*a*) onto said application surface (9*a*) as one of the foam and the gel in response to an actuation of said actuating valve (4).

2. A device according to claim 1, wherein said at least one duct (10) is substantially perpendicular to the application surface (9*a*).

3. A device according to claim 2, further comprising a plurality of said ducts (10), each with a respective one of said openings (10*a*).

4. A device according claim 3, wherein the plurality of openings (10*a*) are uniformly distributed over the application surface (9*a*).

5. A device according to claim 3, wherein the plurality of openings (10*a*) are uniformly distributed.

6. A device according to claim 3, wherein the pluralty of openings (10*a*) have a width of from 0.4 mm to 6 mm.

7. A device according to claim 3, wherein the plurality of openings (10*a*) have shapes which are at least one of oval, elliptical, square, rectangular, circular, star-shaped and circular arcuate.

8. A device according to claim 1, wherein the at least one duct (10) is parallel to the axis (A).

9. A device according to claim 1, wherein the at least one duct (10) is inclined relative to the axis (A).

10. A device according to claim 1, wherein the at least one duct (10) is conical.

11. A device according to claim 1, wherein the applicator element is made of a sintered material.

12. A device according to claim 11, wherein said sintered material is chosen from one of ethylene vinyl acetate (EVA) and synthetic resins.

13. A device according to claim 1, wherein the application surface (9*a*) has a roughness of from 0.5 $\mu$m to 100 $\mu$m.

14. A device according claim 1, wherein a porosity of the material is from 1 $\mu$m to 300 $\mu$m.

15. A device according to claim 1, wherein the applicator element has a thickness of from 0.5 mm to 20 mm.

16. A device according to claim 1, further comprising the product, wherein the product comprises one of shaving foams, hair setting products, and depilatory foams.

17. A device according to claim 3, wherein the plurality of openings are distributed along one of concentric circles and parallel lines.

18. A device according to claim 1, characterized in that it comprises a support (8) on which the applicator element is fixed.

19. A device according to claim 18, wherein the support (8) has a support duct (8*c*) causing a stem (6) of said actuating valve and the applicator element (9) to communicate, the duct (8*c*) forming an angle relative to an axis (X) of the valve.

20. A device according to claim 1, wherein said applicator element is a hollow dome.

21. A device according to claim 1, wherein said applicator element resists passage therethrough of the product in the form of the foam and the gel, and comprises an expansion chamber (13) that is in communication with said actuating valve and is interior to said applicator element and beneath said external application surface (9*a*) for permitting expansion of the liquid product received from said actuating valve.

* * * * *